US009444228B2

(12) United States Patent
Niessner et al.

(10) Patent No.: US 9,444,228 B2
(45) Date of Patent: Sep. 13, 2016

(54) SPARK PLUG

(71) Applicant: Federal-Mogul Ignition GmbH, Neuhaus-Schierschnitz (DE)

(72) Inventors: Werner Niessner, Steinheim (DE); Alexander Schenk, Waiblingen (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 0 days.

(21) Appl. No.: 14/672,383

(22) Filed: Mar. 30, 2015

(65) Prior Publication Data

US 2015/0311679 A1 Oct. 29, 2015

(30) Foreign Application Priority Data

Apr. 23, 2014 (DE) ..... 10 2014 105 687

(51) Int. Cl.

| | |
|---|---|
| ***H01T 13/20*** | (2006.01) |
| ***H01T 13/32*** | (2006.01) |
| ***H01T 13/36*** | (2006.01) |
| *H01T 13/52* | (2006.01) |

(52) U.S. Cl.

CPC ..... *H01T 13/32* (2013.01); *H01T 13/36* (2013.01); *H01T 13/52* (2013.01)

(58) Field of Classification Search

CPC ..... H01T 13/32; H01T 13/36; H01T 13/52
See application file for complete search history.

(56) References Cited

U.S. PATENT DOCUMENTS

| | | | | |
|---|---|---|---|---|
| 3,719,851 | A | 3/1973 | Burley | |
| 4,110,667 | A | 8/1978 | Graf Vom Hagen | |
| 4,795,937 | A * | 1/1989 | Wagner | H01T 13/54 313/123 |
| 4,814,664 | A * | 3/1989 | Rothenbuhler | H01T 13/52 116/208 |
| 4,963,784 | A | 10/1990 | Niessner | |
| 8,890,398 | B2 | 11/2014 | Schenk et al. | |
| 2007/0216276 | A1 * | 9/2007 | Takada | H01T 13/20 313/141 |

FOREIGN PATENT DOCUMENTS

| | | |
|---|---|---|
| DE | 24 37 257 A1 | 2/1976 |
| DE | 35 44 176 C1 | 5/1987 |
| DE | 38 16 968 A1 | 11/1989 |
| DE | 11 2008 002 535 T5 | 8/2010 |
| DE | 10 2011 002 167 A1 | 6/2012 |
| JP | 2013165016 A | 8/2013 |
| WO | 2009039478 A2 | 3/2009 |

* cited by examiner

*Primary Examiner* — Donald Raleigh
(74) *Attorney, Agent, or Firm* — Reising Ethington, P.C.

(57) ABSTRACT

A spark plug having a front end of a spark plug body that projects over a front end of an insulator, a recess that is arranged at the front end of the insulator from which a center electrode projects and forms an air spark gap with a ground electrode, an annular intermediate space that is formed by the recess between the insulator and the center electrode, and a surface of the recess that runs in an at least partially curved manner between the center electrode and the end of the spark plug body so that the recess forms an insulating section that prevents a sliding spark between the center electrode and the spark plug body.

11 Claims, 2 Drawing Sheets

SPARK PLUG

Figure 1:
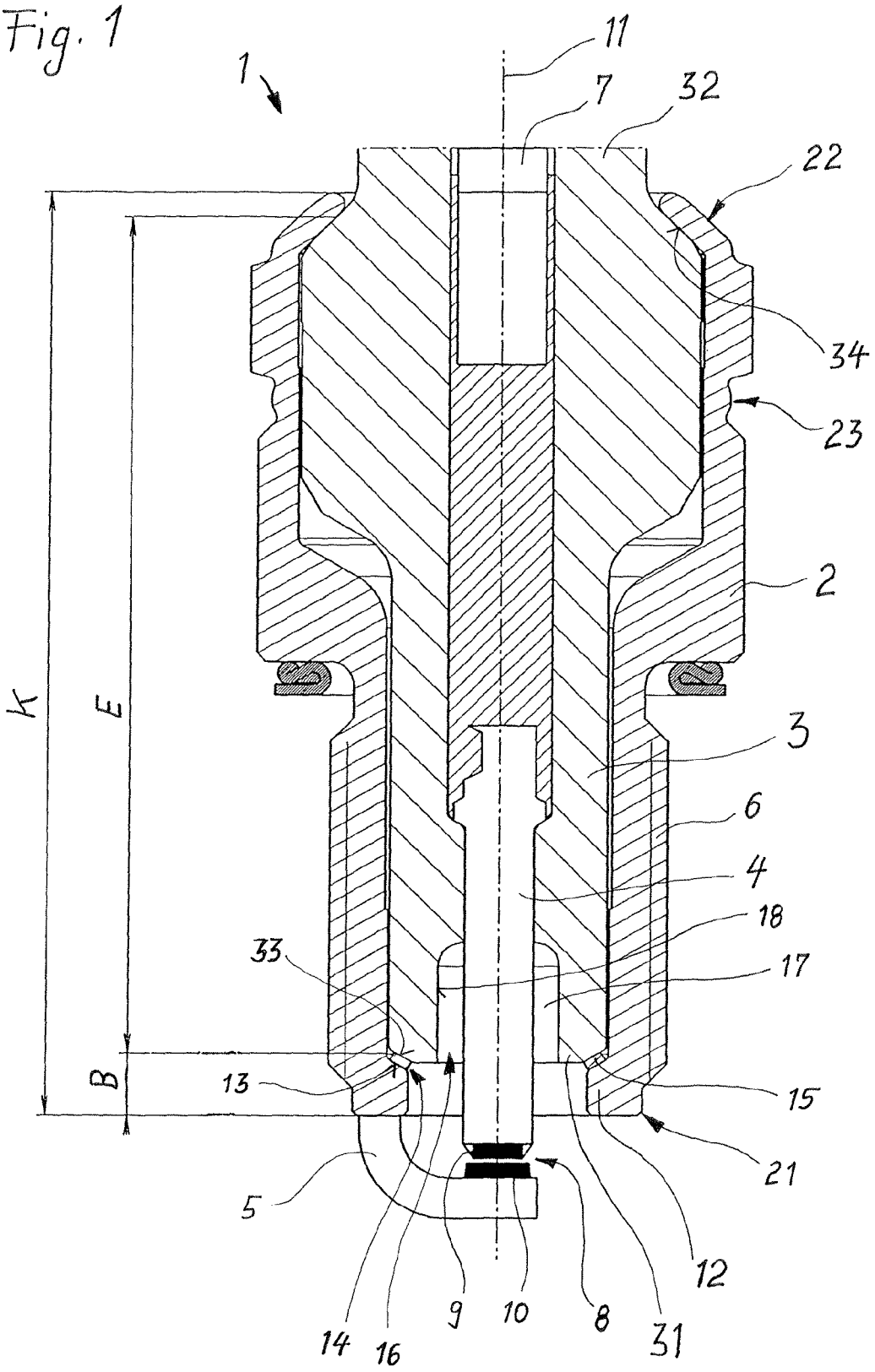

This application claims priority to German Patent Application No. 10 2014 105 687.6, filed Apr. 23, 2014, the entire content of which is hereby incorporated by reference.

FIELD

The invention proceeds from a spark plug with an inner conductor, a center electrode connected with the inner conductor, an insulator surrounding the inner conductor and having a front end and a rear end, a spark plug body surrounding the insulator and having a front end and a rear end, and a ground electrode connected with the front end of the spark plug body, wherein the front end of the spark plug body projects over the front end of the insulator, and wherein the insulator has at its front end a surface region lying between center electrode and spark plug body, which surface region forms an insulating section preventing a sliding spark between the center electrode and the spark plug body.

BACKGROUND

Through recent developments in engine technology, in particular through the operating of Otto engines at substantially increased pressures, the stresses to which spark plugs are exposed have increased considerably. Through this, damages occur very frequently to the ceramic of the insulator, in particular in the region of a front, exposed section of the insulator facing the combustion chamber of the engine, hereinbelow also designated as the insulator foot, which in high performance engines is exposed to very high thermal, mechanical, electrical and thermo-mechanical stresses. The occurrence of cracks in the insulator foot is especially problematic. These can be caused by engine vibrations. Uncontrolled combustions can lead to intensive pressure waves or shock waves, which can lead to fractures of the ceramic insulator. The fuel, which is injected at high pressure can, if it comes in contact with the ceramic insulator, trigger a temperature shock, which can likewise lead to cracks in the ceramic. A spark plug of the type named in the introduction is known from DE 10 2011 002 167 A1, in which in view of the above-mentioned problems it is proposed, for improvement, to construct the spark plug so that the insulator foot lies within the spark plug body and is thereby shielded and protected from shock waves and temperature shocks.

Furthermore, in modern high performance engines it is important that the spark plug is able to reliably inflame the frequently very lean fuel-air mixture. One speaks in terms of a lean fuel-air mixture when the ratio of the air quantity actually present in the combustion chamber to the air quantity necessary stoichiometrically for a complete combustion of the fuel is greater than 1. The ignition voltages are therefore increased in high performance engines and can be up to 35 kV. Also in the case of high ignition voltages, the surface region of the insulator which lies at the front end of the insulator between the center electrode and the spark plug body, must form an insulating section, which reliably prevents the occurrence of sliding sparks between the center electrode and the spark plug body. One speaks in terms of a sliding spark when the ignition spark spreads out at least in sections along the surface of the insulator or sweeps over the surface of the insulator. In contrast thereto, one speaks in terms of an air spark when the ignition spark forms over a free air gap between the center- and ground electrode, without touching other components. Sliding sparks should not occur in modern high performance engines, because they can no longer reliably ignite very lean fuel-air mixtures. Sliding sparks can therefore lead to undesired ignition failures. A configuration of the front end of the insulator in the form of an insulator foot has for a long time proved successful in order to reliably prevent the occurrence of sliding sparks. DE 10 2011 002 167 A1 therefore retains the proven concept of a spark plug with an insulator foot and shields the latter from influences from the combustion chamber.

From the documents DE 24 37 257 A1, DE 35 44 176 C1 and DE 38 16 968 A1, which are already over 25 years old, non-generic spark plugs are known, which have combined sliding- and air spark sections. In the spark plugs disclosed there, the front end of the spark plug body also projects over the front end of the insulator. In addition, at the front end of the spark plug body a seal seat, cooperating with the front end of the insulator, is provided. At the front end of the insulator, a recess is arranged, open to the front end of the spark plug body, into which recess the center electrode projects. At the front end of the spark plug body an inwardly projecting collar is provided, on which the seal seat is arranged. The collar at the front end of the spark plug body serves at the same time as a ground electrode. For this, the internal diameter of the collar is smaller than the internal diameter of the recess at the front end of the insulator in the region adjoining the seal seat. Such spark plugs have already no longer been used in practice for a long time because, as already mentioned, a development of a sliding spark is no longer desired.

Furthermore, non-generic spark plugs are known from WO 2009/039478 A2 and DE 11 2008 002 535 T5, in which in fact a recess which is open towards the front end of the spark plug body is arranged at the front end of the insulator, into which recess the center electrode projects and forms with the ground electrode an air spark section, in which, however, the front end of the insulator projects out from the front end of the spark plug body. Hence, the ceramic of the insulator is exposed there in an unprotected manner to the previously described stressing influences. In addition, the seal seat between the insulator and the spark plug body is moved very far toward the back, so that the distance between the seal seat and the front end of the spark plug body is very great. In the region between the seal seat and the front end of the spark plug body, an annular gap is provided between the insulator and the spark plug body, so that the insulator is neither supported nor guided in radial direction in a very long region from the seal seat up to its front end. The insulator is therefore under great risk of fracture by engine vibrations. This configuration has therefore not found its way into practice.

SUMMARY

The present invention is based on the object of creating a more robust spark plug of the type mentioned in the introduction, on which no sliding sparks occur even at high ignition voltages of modern high performance engines and which has a longer service life than conventional spark plugs in modern high performance engines. This problem is achieved by a spark plug having the features of claim 1. Advantageous further developments of the spark plug are the subject matter of the dependent claims.

The invention may have (but which are not necessary) substantial advantages, such as those of the following paragraphs.

By the seal seat arranged at the front end of the spark plug body, a large clamping length can be realized for the insulator, which ensures a stable and robust mounting of the insulator in the spark plug body and protects the insulator particularly well from damages by vibrations.

The spark plug according to the invention is even more robust and more insensitive with respect to vibrations than known spark plugs with an insulator foot, for example according to DE 10 2011 002 167 A1, in which the front section of the insulator between the seal seat and the front end of the insulator is exposed and is no longer supported.

The insulator does not project beyond the front end of the spark plug body and is therefore well protected by the hollow spark plug body, consisting of metal, which forms the housing of the spark plug. Mechanical stresses by engine vibrations or impact stresses of combustion pressure waves can be received and deflected very well by the spark plug body, without the ceramic of the insulator being exposed to excessive stresses.

The development of sliding sparks and the occurrence of misfirings are reliably prevented. With the configuration according to the invention, sliding spark inception voltages of over 35 kV can be achieved, so that also with an ignition voltage of 35 kV no sliding spark occurs.

The heat introduced from the combustion chamber into the front end of the insulator and the center electrode from the combustion process is dissipated very well to the spark plug body by the configuration according to the invention. The metallic spark plug body passes the heat very well on to the cooled cylinder head or the respective engine block.

Compared to a spark plug in which the front end of the insulator is configured in the form of an insulator foot and the center electrode only projects a little from the front end of the insulator, provision is made in the spark plug according to the invention that the center electrode projects very far out from the insulator, because it projects far into the recess arranged at the front end of the insulator and can even project out over the front end of the insulator or the front end of the spark plug body. Such a large free length of the outward projecting center electrode means a large metallic heat absorption area and in itself would raise the expectation that the heat input via the metallic center electrode into the insulator would have to increase substantially and accordingly lead to higher insulator temperatures. For this reason, in the spark plug of DE 10 2011 002 167 A1, the configuration—proven for a long time—of the insulator foot in combination with a center electrode projecting only slightly out from the front end of the insulator foot was retained in order to keep low the thermal stress of the insulator as a result of a heat absorption by the center electrode coming directly in contact with the combustion gases. Completely surprisingly, however, it was found that an increased heat input via the center electrode projecting far outward can be more than compensated in the spark plug according to the invention by the improved heat dissipation, in particular also by the seal seat arranged at the front end of the spark plug body.

The temperature of the insulator is lowered at its front end, whereby the electric disruptive discharge strength of the insulator, which is temperature-dependent in many ceramic materials, can be increased. The spark plug according to the invention is very robust with respect to high electric stresses, in particular through high ignition voltages.

The construction of the spark plug according to the invention prevents the insulator from being struck by cool fuel droplets.

Temperature shocks which occur in the cylinder of the engine through cold intake air particularly in flushing processes as a result of high valve overlaps can at the most still reach the insulator—which is shielded by the spark plug body—to a minimal extent. In addition, through the lower temperature of the insulator, the temperature difference between insulator and cold intake air is smaller, so that no damage to the insulator is to be expected.

The spark plug according to the invention achieves a very long service life.

The spark plug according to the invention has an inner conductor, a center electrode connected with the inner conductor, an insulator surrounding the inner conductor with a front and a rear end, a spark plug body surrounding the insulator with a front and a rear end, and a ground electrode connected with the front end of the spark plug body. The elongated, hollow spark plug body made of metal receives the elongated insulator made of ceramic. The front end of the spark plug body projects over the front end of the insulator. The rear end of the insulator projects out from the rear end of the spark plug body. The insulator has at its front end a surface region lying between center electrode and spark plug body, which forms an insulating section preventing a sliding spark between the center electrode and the spark plug body. At the front end of the spark plug body, a seal seat, cooperating with the front end of the insulator, is provided. At the front end of the insulator a recess is arranged, open towards the front end of the spark plug body, into which recess the center electrode projects and forms an air spark gap with the ground electrode. By the recess, an annular intermediate space is formed between insulator and center electrode. Here, the region of the recess in the insulator is designated as annular intermediate space which extends from the lowest point of the recess up to the end face of the center electrode, at the most, however, up to the front end face of the insulator. Viewed in a longitudinal section through the spark plug, the surface of the recess runs in an at least partially curved manner between the center electrode and the end of the of the spark plug projecting over the front end of the insulator and has an overall length of 5 mm or more, in particular of 5 mm to 10 mm, measured in the longitudinal section along the curved surface of the recess, so that the recess forms with its surface facing the center electrode an insulating section preventing a sliding spark between the center electrode and the spark plug body.

In an embodiment, the annular intermediate space between the insulator and the center electrode, viewed in a longitudinal section through the spark plug, has a height measured along an imaginary center line of the spark plug, which is greater than a width of the annular intermediate space measured transversely to an imaginary center line of the spark plug. This embodiment facilitates that no sliding spark occurs between the center electrode and the spark plug body. In further embodiment of the invention, the annular intermediate space between the insulator and the center electrode, viewed in a longitudinal section through the spark plug, can have a width measured transversely to an imaginary center line which is 1 mm or more, in particular 1 mm to 3 mm, at the narrowest point of the annular intermediate space. Hereby, the occurrence of a sliding spark is prevented particularly reliably.

At the front end of the spark plug body, a collar can be provided, projecting inwards to an imaginary center line of the spark plug, on which collar the seal seat is arranged. The collar projects into the passage of the hollow spark plug body. The collar forms on its side facing away from the front end of the spark plug body an annular shoulder, on which the front end of the insulator rests and forms the seal seat. The annular shoulder preferably has a conical surface. The smallest distance between the inwardly projecting collar and the imaginary center line of the spark plug can be greater than the greatest distance between the surface of the recess in the insulator and the imaginary center line of the spark plug. This embodiment of the collar is a good compromise between the opposing requirements of protecting and shielding the insulator, preventing the occurrence of sliding sparks and achieving a good heat dissipation. The inwardly projecting collar can have a height of 1 mm to 4 mm, in particular of 2 mm to 3 mm, measured parallel to the imaginary center line of the spark plug. Hereby, the collar is sufficiently stable in order to reliably receive the forces caused by the clamping of the insulator.

In an embodiment of the invention, provision can be made that the surface of the recess in the insulator, viewed in a longitudinal section through the spark plug, runs sectionwise in a straight line. Sections running in a straight line can alternate with curved sections. Hereby, the overall length, measured in the longitudinal section along the curved surface of the recess, which is necessary in order to reliably prevent the occurrence of sliding sparks, can be reduced. The dimensions of the spark plug can thereby be made smaller.

The spark plug according to the invention is particularly well suited for stationary gas-powered internal combustion engines, which are frequently operated with very lean fuel-air mixtures and in which a particularly long service life is required. The spark position and electrode configuration of the ground electrode as front electrode, side electrode, ring electrode or multi-electrode is arbitrary per se, however the at least one air spark gap is preferably arranged symmetrically in relation to the imaginary center line of the spark plug. The center electrode and/or the ground electrode can be reinforced with a precious metal component, in order to reduce the electrode burn-off. In a further embodiment, the center electrode projects out over the front end of the insulator. The center electrode can project out over the front end of the spark plug body, in particular by 1 mm to 5 mm. Particularly, the air spark gap is formed between the end face of the center electrode and the ground electrode. The ground electrode can be configured so as to be rod-shaped and can be welded to the front end of the spark plug body.

DRAWINGS

Further advantages and features will emerge from the following description of some example embodiments in connection with the figures. Identical parts, or parts corresponding to one another are designated with consistent reference numbers in the various examples.

Figure 2:
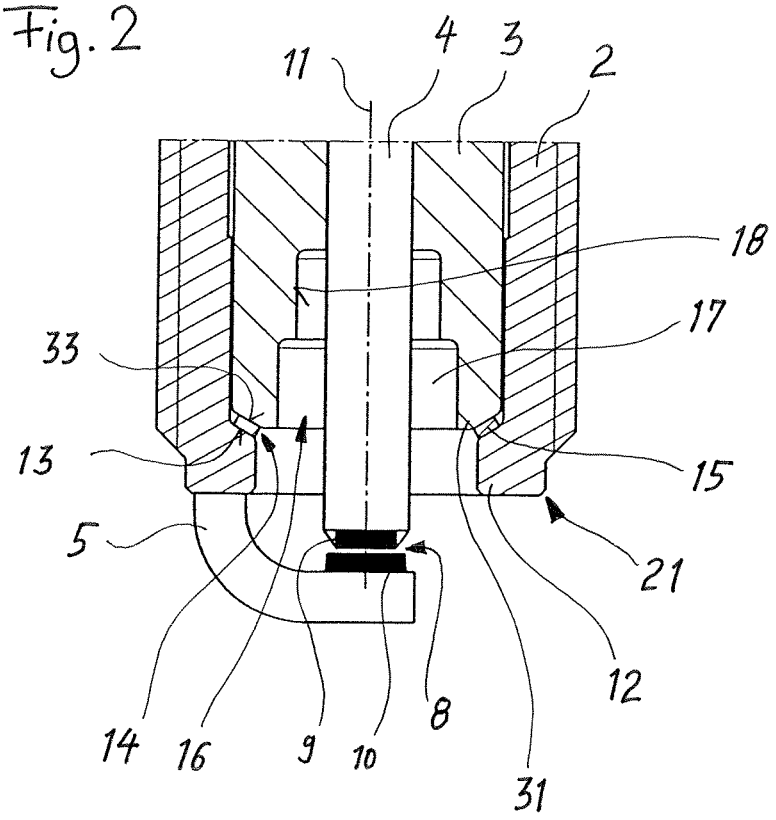

There are shown:

FIG. 1 shows a spark plug according to the invention, in longitudinal section, FIG. 2 shows a view similar to FIG. 1 but focused onto the front end of modified spark plug.

DESCRIPTION

In FIGS. 1 and 2 a spark plug 1 with a hollow spark plug body 2 of metal is illustrated, which forms the housing of the spark plug 1 and receives an insulator 3, in which a center electrode 4 is placed. The spark plug body 2 has a front end 21 and a rear end 22. At the front end 21 a ground electrode 5 is arranged. The spark plug body 2 has at its front end 21 a thread 6, by which the spark plug 1 can be inserted into an internal combustion engine in a manner which is not illustrated but which is known per se. The insulator 3 has a front end 31 and a rear end 32. The front end 21 of the spark plug body 2 projects over the front end 31 of the insulator 3. The rear end 32 of the insulator 3 projects out from the rear end 22 of the spark plug body 2 and is illustrated in shortened form in FIG. 1. In the insulator 3 an inner conductor 7 is arranged, which is connected with the center electrode 4 in an electrically conducting manner by means of a glass material and can project out from the rear end 32 of the insulator 3 in a manner which is not illustrated, so that a spark plug connector, which is not illustrated, can be mounted there, via which the spark plug 1 can be supplied with ignition voltage.

The ground electrode 5 is rod-shaped and is welded to the end face of the front end 21 of the spark plug body 2. The ground electrode 5 is bent so that it forms an air spark section 8 with the end face of the center electrode 4. The center electrode 4 can be provided at its tip with a reinforcement 9 of a precious metal, in particular of platinum and/or iridium. The ground electrode 5 can also have a precious metal reinforcement 10 in the region of the spark gap 8. The precious metal components 9 and 10 are fastened on the respective electrode 4, 5 by means of laser welding.

At the front end 21 of the spark plug body 2 a collar 12 is provided, projecting inwards to an imaginary center line 11 of the spark plug 1. The center line 11 corresponds to the center line of the thread 6. On the side of the collar 12 facing away from the front end 21 a conical annular shoulder 13 is arranged. At the front end 31 of the insulator 3 a conical contact surface 33 is arranged, which is adapted to the conical annular shoulder 13 and forms with the latter a seal seat 14. Between the annular shoulder 13 and the contact surface 33, a sealing ring 15 can be arranged. The insulator 3 has a conical annular shoulder 34 associated with the rear end 22 of the spark plug body 2. After the insertion of the insulator 3 into the spark plug body 2, the rear end 22 of the spark plug body 2 is flanged in over the annular shoulder 34, so that the insulator 3 is pressed with its contact surface 33 against the annular shoulder 13 and the seal seat 14 seals the intermediate space between insulator 3 and spark plug body 2 in a gas-tight manner. The seal seat 14 ensures in addition a good heat transmission from the insulator 3 to the spark plug body 2. To increase the prestressing force on the seal seat 14 and to improve the sealing, an electric upsetting process, known per se, can be carried out on an annular cut-in 23 of the spark plug body 2. With respect to the overall length K of the spark plug body 2 from its front end 21 to its rear end 22, a very large clamping length E of the insulator 3 from the annular shoulder 34 to the contact surface 33 can be achieved, which ensures a high degree of stability and a great robustness of the spark plug 1 or respectively of the insulator 3. The height B of the collar 12, measured parallel to the imaginary center line 11 of the spark plug 1, is 1 mm to 4 mm, in particular 2 mm to 3 mm. Hereby, it is achieved that the seal seat 14 lies as close as possible at the front end 21 of the spark plug body 2 and at the same time the forces which occur on bracing of the insulator 3 during the mounting steps of flanging of the rear end 22 and of the electric upsetting process can be reliably received without undesired deformations of the seal seat 14 taking place.

At the front end 31 of the insulator 3, a recess 16 is arranged, open towards the front end 21 of the spark plug body 2, into which recess the center electrode 4 projects. By the recess 16, which has a cup-shaped form in FIG. 1, an annular intermediate space 17 is formed between insulator 3 and center electrode 4. The surface 18 of the recess 16 extends from the site at which the center electrode 4 emerges out from the insulator 3 at the base of the recess 16, up to the front end 31 of the insulator 3. The surface 18 is configured so that it forms an insulating section preventing a sliding spark between the center electrode 4 and the spark plug body 2. For this, the surface 18 runs in an at least partially curved manner, namely in the region where the center electrode 4 emerges out from the insulator 3. At the exit site, the angle formed in the longitudinal section by the surface 18 and the surface of the center electrode 4 is in particular approximately 90°. The annular intermediate space 17 therefore does not taper off acutely. The occurrence of a sliding spark thereby can be reliably prevented. Furthermore, the surface 18 has an overall length, measured in longitudinal section along its curvature, of 5 mm to 10 mm. In FIG. 1 it can be seen that the annular intermediate space 17 has a height, measured along the center line 11, which is greater than a width measured transversely to the center line 11. In the spark plugs 1 illustrated in FIGS. 1 and 2, both the recess 16 and also the center electrode 4 have a circular cross-section. The width of the annular intermediate space 17 measured transversely to the center line 11 is the difference of the radii of recess 16 and center electrode 4, measured in a cross-section (not illustrated) through the spark plug 1. The width of the annular intermediate space 17 is 1 mm to 3 mm. The smallest distance between center line 11 and collar 12 is greater than the distance between center line 11 and surface 18 of the recess 16.

In FIG. 2 a variant of a spark plug 1 is illustrated, in which the insulator 3 has a differently shaped recess 16. The recess 16 in the spark plug 1 of FIG. 2 widens towards the front end 31 of the insulator 3 and is embodied as a stepped bore. In the longitudinal section of FIG. 2 it can be seen that the surface 18 runs section-wise in a straight line and section-wise in a curved manner, wherein sections running in a straight line and in a curved manner alternate. Such a configuration is likewise favourable for the avoidance of sliding sparks.

| List of reference numbers | |
|---|---|
| 1 | spark plug |
| 2 | spark plug body |
| 3 | insulator |
| 4 | center electrode |
| 5 | ground electrode |
| 6 | thread |
| 7 | inner conductor |
| 8 | air spark gap |
| 9 | precious metal reinforcement |
| 10 | precious metal reinforcement |
| 11 | center line |
| 12 | collar |
| 13 | annular shoulder |
| 14 | seal seat |
| 15 | sealing ring |
| 16 | recess |
| 17 | intermediate space |
| 18 | surface |
| 21 | front end of the spark plug body 2 |
| 22 | rear end of the spark plug body 2 |
| 23 | cut-in |
| 31 | front end of the insulator 3 |
| 32 | rear end of the insulator 3 |
| 33 | contact surface |
| 34 | annular shoulder |
| B | height of the collar 12 |
| E | clamping length of the insulator 3 |
| K | overall length of the spark plug body 2 |

The invention claimed is:

1. A spark plug comprising an inner conductor, a center electrode connected with the inner conductor, an insulator surrounding the inner conductor and having a front end and a rear end, a spark plug body surrounding the insulator and having a front end and a rear end, and a ground electrode connected with the front end of the spark plug body;

the front end of the spark plug body projects over the front end of the insulator;

the insulator has at its front end a surface region lying between center electrode and the spark plug body, which surface region forms an insulating section preventing a sliding spark between the center electrode and the spark plug body;

at the front end of the spark plug body a seal seat is provided, cooperating with the front end of the insulator to form a gas-tight seal between the insulator and the spark plug body;

at the front end of the insulator a recess is arranged, open towards the front end of the spark plug body, into which recess the center electrode projects and forms an air spark gap with the ground electrode;

through the recess an annular intermediate space is formed between the insulator and the center electrode; and wherein a surface of the recess, viewed in a longitudinal section through the spark plug, runs in an at least partially curved manner between the center electrode and the end of the spark plug body projecting over the front end of the insulator, and has an overall length of 5 mm or more, measured in the longitudinal section along the curved surface of the recess, so that the recess forms with its surface, facing the center electrode, an insulating section preventing a sliding spark between the center electrode and the spark plug body.

2. The spark plug according to claim 1, in which the annular intermediate space between insulator and the center electrode, viewed in a longitudinal section through the spark plug, has a height measured along an imaginary center line of the spark plug which is greater than a width of the annular intermediate space measured transversely to an imaginary center line of the spark plug.

3. The spark plug according to claim 1, in which the center electrode projects out over the front end of the insulator.

4. The spark plug according to claim 1, in which the center electrode projects out over the front end of the spark plug body.

5. The spark plug according to claim 1, in which the recess, viewed in a longitudinal section through the spark plug, between the center electrode and the end of the spark plug body projecting over the front end of the insulator, has an overall length of 5 mm to 10 mm, measured in the longitudinal section along the curved surface of the recess.

6. A spark plug comprising an inner conductor, a center electrode connected with the inner conductor, an insulator surrounding the inner conductor and having a front end and a rear end, a spark plug body surrounding the insulator and having a front end and a rear end, and a ground electrode connected with the front end of the spark plug body;

the front end of the spark plug body projects over the front end of the insulator;

the insulator has at its front end a surface region lying between center electrode and the spark plug body, which surface region forms an insulating section preventing a sliding spark between the center electrode and the spark plug body;

at the front end of the spark plug body a seal seat is provided, cooperating with the front end of the insulator;

at the front end of the insulator a recess is arranged, open towards the front end of the spark plug body, into which recess the center electrode projects and forms an air spark gap with the ground electrode;

through the recess an annular intermediate space is formed between the insulator and the center electrode, the annular intermediate space, viewed in a longitudinal section through the spark plug, having a width measured transversely to an imaginary center line of the spark plug, the width at the narrowest point of the annular intermediate space being 1 mm or more; and wherein a surface of the recess, viewed in a longitudinal section through the spark plug, runs in an at least partially curved manner between the center electrode and the end of the spark plug body projecting over the front end of the insulator, and has an overall length of 5 mm or more, measured in the longitudinal section along the curved surface of the recess, so that the recess forms with its surface, facing the center electrode, an insulating section preventing a sliding spark between the center electrode and the spark plug body.

7. The spark plug according to claim 1, in which at the front end of the spark plug body a collar is provided, projecting inwards to an imaginary center line of the spark plug, on which collar the seal seat is arranged.

8. A spark plug comprising an inner conductor, a center electrode connected with the inner conductor, an insulator surrounding the inner conductor and having a front end and a rear end, a spark plug body surrounding the insulator and having a front end and a rear end, and a ground electrode connected with the front end of the spark plug body;

the front end of the spark plug body projects over the front end of the insulator;

the insulator has at its front end a surface region lying between center electrode and the spark plug body, which surface region forms an insulating section preventing a sliding spark between the center electrode and the spark plug body;

at the front end of the spark plug body a collar and a seal seat is provided, the seal seat cooperating with the front end of the insulator and the collar projecting inwards to an imaginary center line of the spark plug, on which collar the seal seat is arranged;

at the front end of the insulator a recess is arranged, open towards the front end of the spark plug body, into which recess the center electrode projects and forms an air spark gap with the ground electrode;

through the recess an annular intermediate space is formed between the insulator and the center electrode; and wherein a surface of the recess, viewed in a longitudinal section through the spark plug, runs in an at least partially curved manner between the center electrode and the end of the spark plug body projecting over the front end of the insulator, and has an overall length of 5 mm or more, measured in the longitudinal section along the curved surface of the recess, so that the recess forms with its surface, facing the center electrode, an insulating section preventing a sliding spark between the center electrode and the spark plug body, wherein the smallest distance between the inwardly projecting collar and the imaginary center line of the spark plug is greater than the greatest distance between the surface of the recess in the insulator and the imaginary center line of the spark plug.

9. The spark plug according to claim 7, in which the inwardly projecting collar has a height of 1 mm to 4 mm measured parallel to the imaginary center line of the spark plug.

10. The spark plug according to claim 1, in which the surface of the recess in the insulator, viewed in a longitudinal section through the spark plug, runs section-wise in a straight line.

11. The spark plug according to claim 1, in which the air spark gap is formed between the end face of the center electrode and the ground electrode.

* * * * *